US012497257B2

(12) United States Patent
Minemura et al.

(10) Patent No.: US 12,497,257 B2
(45) Date of Patent: Dec. 16, 2025

(54) TRANSPORT DEVICE AND LIQUID EJECTION DEVICE

(71) Applicant: SEIKO EPSON CORPORATION, Tokyo (JP)

(72) Inventors: Satoshi Minemura, Matsumoto (JP); Tomonori Amari, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 352 days.

(21) Appl. No.: 18/184,510

(22) Filed: Mar. 15, 2023

(65) Prior Publication Data

US 2023/0294948 A1 Sep. 21, 2023

(30) Foreign Application Priority Data

Mar. 16, 2022 (JP) ..... 2022-041309

(51) Int. Cl.
*B65H 20/06* (2006.01)
*B65H 26/02* (2006.01)

(52) U.S. Cl.
CPC ..... *B65H 20/06* (2013.01); *B65H 26/02* (2013.01); *B65H 2301/44335* (2013.01); *B65H 2404/1522* (2013.01); *B65H 2404/1532* (2013.01); *B65H 2404/5391* (2013.01); *B65H 2513/10* (2013.01); *B65H 2515/34* (2013.01); *B65H 2515/40* (2013.01); *B65H 2801/03* (2013.01)

(58) Field of Classification Search
CPC ..... B65H 5/025; B65H 5/021; B65H 5/36; B65H 20/06; B65H 2301/44335; B65H 2404/1522; B65H 2404/1532; B65H 2404/5391; B41J 13/08; B41J 15/048; B41J 29/46
See application file for complete search history.

(56) References Cited

U.S. PATENT DOCUMENTS

| | | | | |
|---|---|---|---|---|
| 5,883,654 | A * | 3/1999 | Katsuyama | B65H 20/02 347/104 |
| 8,167,423 | B2 * | 5/2012 | Mochizuki | B41J 11/0045 347/101 |
| 9,393,806 | B2 * | 7/2016 | Ishizuka | B41J 3/4078 |
| 9,931,868 | B2 * | 4/2018 | Yamashita | B41J 11/007 |
| 10,059,125 | B2 * | 8/2018 | Okumura | B41J 11/04 |
| 11,208,630 | B2 * | 12/2021 | Clement | C12N 7/00 |
| 11,225,095 | B2 * | 1/2022 | Kitahara | B65H 7/06 |

(Continued)

FOREIGN PATENT DOCUMENTS

| | | | | |
|---|---|---|---|---|
| JP | 2016150435 A | * | 8/2016 | |
| JP | 2017128828 A | * | 7/2017 | B41J 11/0005 |
| JP | 2021-046296 A | | 3/2021 | |

*Primary Examiner* — Leslie A Nicholson, III
(74) *Attorney, Agent, or Firm* — WORKMAN NYDEGGER

(57) ABSTRACT

A transport unit includes a glue belt, a pressurizing roller, a roller driving unit, and a control unit. The glue belt includes an adhesive layer. The pressurizing roller presses a medium against the adhesive layer while reciprocating in a Y direction. The roller driving unit generates a driving force for the pressurizing roller to reciprocate. The control unit controls the roller driving unit. The pressurizing roller is separated from the adhesive layer along with reciprocation. The control unit is capable of detecting a load of the roller driving unit, and determines whether the magnitude of the adhesive force of the adhesive layer is less than a target value, based on the load.

10 Claims, 12 Drawing Sheets

(56) References Cited

U.S. PATENT DOCUMENTS

| | | | | |
|---|---|---|---|---|
| 11,383,542 | B2 * | 7/2022 | Kitagishi | B65H 29/54 |
| 12,017,880 | B2 * | 6/2024 | Asamoto | B65H 37/02 |
| 12,098,054 | B2 * | 9/2024 | Yumoto | B41J 29/17 |
| 12,214,988 | B2 * | 2/2025 | Kamiyama | B65H 5/025 |
| 2014/0193187 | A1 * | 7/2014 | Ishizuka | B41J 11/007 400/618 |
| 2021/0086537 | A1 | 3/2021 | Kitagishi et al. | |

* cited by examiner

TRANSPORT DEVICE AND LIQUID EJECTION DEVICE

The present application is based on, and claims priority from JP Application Serial Number 2022-041309, filed Mar. 16, 2022, the disclosure of which is hereby incorporated by reference herein in its entirety.

BACKGROUND

1. Technical Field

The present disclosure relates to a transport device and a liquid ejection device.

2. Related Art

A recording system of JP-A-2021-46296 includes a transport belt that transports a medium caused to adhere to an adhesive layer, a driving unit that drives a driving roller around which the transport belt is wound, a control unit that includes a detection unit for detecting a load current flowing to the driving unit and controls the driving unit, and a peeling device that peels off the medium from the transport belt. The control unit issues a notification indicating a replacement timing of the adhesive layer, based on a detection result of the detection unit.

In a configuration in which a flowing load current in the driving unit for driving the driving roller around which the transport belt is wound is detected as in the recording system of JP-A-2021-46296, the transport belt may slip with respect to the driving roller due to a load at the time of peeling off the medium. Further, when the transport belt slips with respect to the driving roller, a correlation between a load acting on the driving roller and the adhesive force of the adhesive layer cannot be grasped. With this, there may be a risk that the magnitude of the adhesive force of the adhesive layer cannot be determined.

SUMMARY

In order to solve the above-mentioned problem, a transport device according to an aspect of the present disclosure includes a transport belt including an adhesive layer and configured to transport a medium caused to adhere to the adhesive layer, a pressing unit configured to press the medium against the adhesive layer while reciprocating in a transport direction in which the medium is transported and a reverse transport direction opposite to the transport direction, the pressing unit being configured to come into contact with the adhesive layer at at least a part of the pressing unit, a driving unit configured to generate a driving force for the pressing unit to reciprocate in the transport direction and the reverse transport direction, and a control unit configured to control the driving unit, wherein the pressing unit is separated from the adhesive layer along with reciprocation in the transport direction and the reverse transport direction, and the control unit is configured to detect a load of the driving unit, and determines a magnitude of an adhesive force of the adhesive layer, based on the load.

In order to solve the above-mentioned problem, a liquid ejection device according to an aspect of the present disclosure includes an ejection unit configured to eject a liquid onto a medium, a transport belt including an adhesive layer and configured to transport the medium caused to adhere to the adhesive layer, a pressing unit configured to press the medium against the adhesive layer while reciprocating in a transport direction in which the medium is transported and a reverse transport direction opposite to the transport direction, the pressing unit being configured to come into contact with the adhesive layer at at least a part of the pressing unit, a driving unit configured to generate a driving force for the pressing unit to reciprocate in the transport direction and the reverse transport direction, and a control unit configured to control the driving unit, wherein the pressing unit is separated from the adhesive layer along with reciprocation in the transport direction and the reverse transport direction, and the control unit is configured to detect a load of the driving unit, and determines a magnitude of an adhesive force of the adhesive layer, based on the load.

DESCRIPTION OF EXEMPLARY EMBODIMENTS

Figure 1:
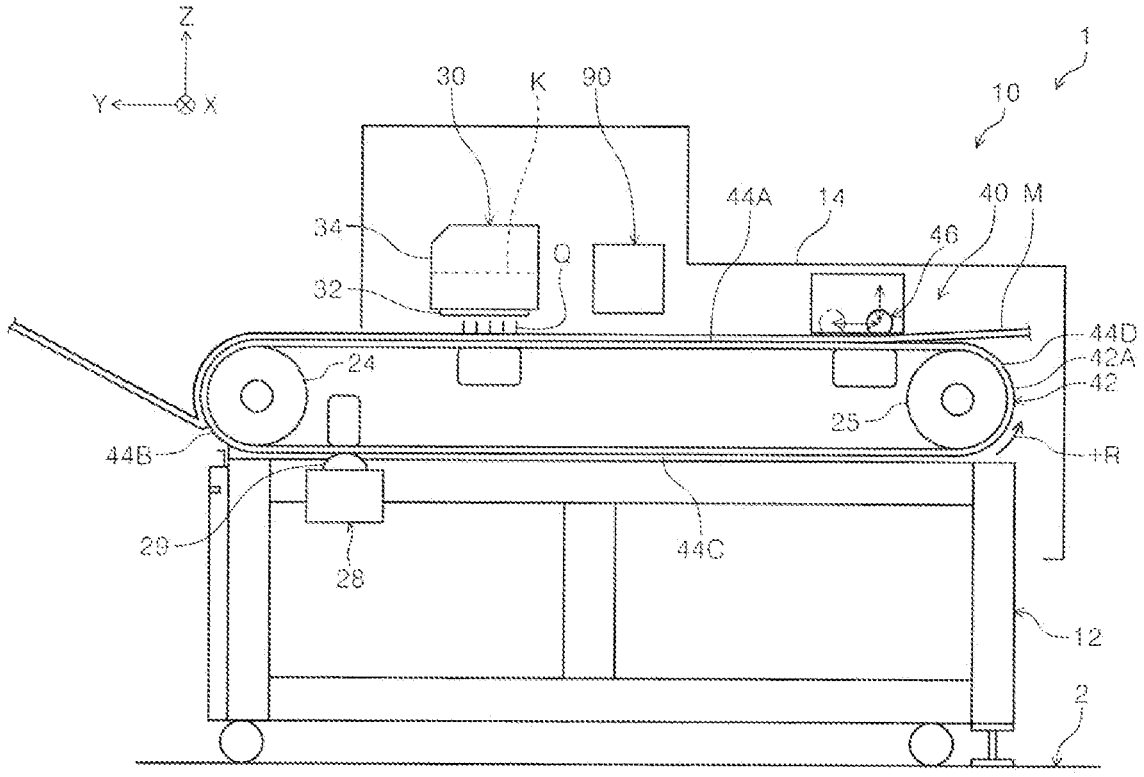
FIG. 1 is a schematic view of an internal structure of a printer according to a first exemplary embodiment.

Hereinafter, the present disclosure is schematically described.

A transport device according to a first aspect includes a transport belt including an adhesive layer and configured to transport a medium caused to adhere to the adhesive layer, a pressing unit configured to press the medium against the adhesive layer while reciprocating in a transport direction in which the medium is transported and a reverse transport direction opposite to the transport direction, the pressing unit being configured to come into contact with the adhesive layer at at least a part of the pressing unit, a driving unit configured to generate a driving force for the pressing unit to reciprocate in the transport direction and the reverse transport direction, and a control unit configured to control the driving unit, wherein the pressing unit is separated from the adhesive layer along with reciprocation in the transport direction and the reverse transport direction, and the control unit is configured to detect a load of the driving unit, and determines a magnitude of an adhesive force of the adhesive layer, based on the load.

According to the present aspect, at least a part of the pressing unit is in contact with the adhesive layer. Further, the pressing unit is driven by the driving unit to reciprocate in the transport direction and the reverse transport direction, and presses the medium against the adhesive layer. At this state, the pressing unit repeatedly comes into contact with and is separated from the adhesive layer along with reciprocation. Here, the control unit determines the magnitude of the adhesive force of the adhesive layer, based on the load of the driving unit. For example, when a load smaller than a predetermined load acts on the driving unit, the control unit determines that the magnitude of the adhesive force of the adhesive layer is less than the target value. In this manner, the load acting on the pressing unit coming into contact with the adhesive layer is directly detected, and thus an influence due to slippage of the transport belt or the like can be suppressed as compared to a configuration of detecting driving of the transport belt. Thus, a magnitude of the adhesive force can be determined at a high accuracy.

Note that the adhesive force can be secured by forming a new adhesive layer with a method of applying an adhesive material onto the transport belt or the like.

In the first aspect, in the transport device according to a second aspect, the transport belt is a cylindrical belt member, and the control unit detects the load of the driving unit while circularly moving the transport belt.

According to the present aspect, the load of the driving unit is detected while circularly moving the transport belt. Thus, the adhesive force can be determined at a plurality of positions of the transport belt in the circumferential direction.

In the first aspect or the second aspect, in the transport device according to a third aspect, the pressing unit is provided such that a pressing force when pressing the medium against the transport belt is changeable, and when it is determined that a magnitude of the adhesive force is less than a target value, the control unit controls the pressing unit to increase the pressing force.

According to the present aspect, when a magnitude of the adhesive force is small, the pressing force generated by the pressing unit is increased, and thus the contact area between the medium and the adhesive layer is increased. With this, the adhesive force acting on the medium can be secured, and thus the position deviation of the medium with respect to the transport belt can be suppressed.

In any one of the first aspect to the third aspect, in the transport device according to a fourth aspect, the pressing unit includes a heating unit configured to heat the medium, and when it is determined that a magnitude of the adhesive force is less than the target value, the control unit increases an output of the heating unit to increase a temperature of the medium. According to the present aspect, when a magnitude of the adhesive force is reduced, an output of the heating unit is increased. Thus, a temperature of the medium is increased, and a temperature of the adhesive layer is also increased. With this, the adhesive force of the adhesive layer with respect to the medium can be increased.

In any one of the first aspect to the fourth aspect, in the transport device according to a fifth aspect, the control unit is configured to execute a determination mode in which the adhesive force is determined based on the load and a transport mode in which the medium is transported after the determination mode, and the control unit controls the driving unit so that a first speed is higher than a second speed, the first speed being a speed of the pressing unit at which the pressing unit moves in the determination mode and the second speed being a speed of the pressing unit at which the pressing unit moves in the transport mode.

According to the present aspect, the first speed is higher than the second speed, and thus a time period during which the pressing unit is in contact with the adhesive layer is reduced. With this, removal of a part of the adhesive layer by the pressing unit can be suppressed, and thus degradation of adhesiveness of the medium with respect to the transport belt can be suppressed.

In any one of the first aspect to the fourth aspect, in the transport device according to a sixth aspect, the control unit is configured to execute a determination mode in which the adhesive force is determined based on the load and a transport mode in which the medium is transported after the determination mode, and the control unit controls the driving unit so that a first speed is lower than a second speed, the first speed being a speed of the pressing unit at which the pressing unit moves in the determination mode and the second speed being a speed of the pressing unit at which the pressing unit moves in the transport mode.

According to the present aspect, the first speed is smaller than the second speed, and thus a time period during which the pressing unit is capable of coming into contact with the adhesive layer is increased. In other words, the number of times at which the pressing unit comes into contact with the adhesive layer is increased. With this, even with a configuration in which there is variation in a gap between the pressing unit and the adhesive layer, contact between the pressing unit and the adhesive layer can be performed in a wide range. Thus, detection accuracy of the adhesive force can be improved.

In any one of the first aspect to the sixth aspect, the transport device according to a seventh aspect further includes a notification unit configured to issue a notification relating to information, wherein when it is determined that a magnitude of the adhesive force is less than the target value, the control unit causes the notification unit to issue a notification relating to information indicating reduction in the magnitude of the adhesive force.

According to the present aspect, the notification unit issues a notification relating to the information indicating reduction in the magnitude of the adhesive force, and thus a user is easily allowed to grasp a condition of the adhesive force.

A transport device according to an eighth aspect includes a transport belt including an adhesive layer and configured to transport a medium caused to adhere to the adhesive layer, a pressing unit that is provided movably in an intersecting direction intersecting with a transport direction in which the medium is transported and that is configured to press the medium against the adhesive layer, the pressing unit being configured to come into contact with the adhesive layer at at least a part of the pressing unit, a second driving unit configured to generate a driving force for the pressing unit to move in the intersecting direction, and a control unit configured to control the other driving unit, wherein the pressing unit is separated from the adhesive layer along with movement in the intersecting direction, and the control unit is configured to detect a load of the other driving unit, and determines a magnitude of an adhesive force of the adhesive layer, based on the load.

According to the present aspect, the pressing unit is driven by the other driving unit, and thus moves to one side in the intersecting direction. With this, the pressing unit comes into contact with the adhesive layer. Further, the pressing unit is driven by the other driving unit, and thus moves to the other side in the intersecting direction. With this, the pressing unit is separated from the adhesive layer.

Here, the control unit determines the magnitude of the adhesive force of the adhesive layer, based on the load of the other driving unit. For example, when a load smaller than a predetermined load acts on the other driving unit, the control unit determines that the magnitude of the adhesive force of the adhesive layer is less than the target value. In this manner, the load acting on the pressing unit coming into contact with the adhesive layer is directly detected, and thus an influence due to slippage of the transport belt or the like can be suppressed as compared to a configuration of detecting driving of the transport belt. Thus, a magnitude of the adhesive force can be determined at a high accuracy.

A transport device according to a ninth aspect includes a transport belt including an adhesive layer and configured to transport a medium caused to adhere to the adhesive layer, a pressing unit that is provided reciprocably in a transport direction in which the medium is transported and a reverse transport direction opposite to the transport direction and that is configured to press the medium against the adhesive layer, the pressing unit being configured to come into contact with the adhesive layer at at least a part of the pressing unit, a regulation unit configured to regulate reciprocation of the pressing unit, and a control unit configured to control the regulation unit, wherein the pressing unit is configured to be separated from the adhesive layer along with movement of the transport belt, and the control unit is configured to detect a load acting on the regulation unit when the regulation unit regulates the pressing unit, and determines a magnitude of an adhesive force of the adhesive layer, based on the load.

According to the present aspect, the pressing unit presses the medium against the adhesive layer. At least a part of the pressing unit is in contact with the adhesive layer. Here, when the transport belt moves, the control unit controls the regulation unit, and thus regulates movement of the pressing unit. Further, in a regulation state, the pressing unit is separated from the adhesive layer along with movement of the transport belt.

At this state, the control unit detects a load acting on the regulation unit, and thus determines the magnitude of the adhesive force of the adhesive layer. For example, when a load smaller than a predetermined load acts on the regulation unit, the control unit determines that the magnitude of the adhesive force of the adhesive layer is less than the target value. In this manner, the load acting on the pressing unit coming into contact with the adhesive layer is directly detected using the regulation unit, and thus an influence due to slippage of the transport belt or the like can be suppressed as compared to a configuration of detecting driving of the transport belt. Thus, a magnitude of the adhesive force can be determined at a high accuracy.

A liquid ejection device according to a tenth aspect includes an ejection unit configured to eject a liquid onto a medium, a transport belt including an adhesive layer and configured to transport the medium caused to adhere to the adhesive layer, a pressing unit configured to press the medium against the adhesive layer while reciprocating in a transport direction in which the medium is transported and a reverse transport direction opposite to the transport direction, the pressing unit being configured to come into contact with the adhesive layer at at least a part of the pressing unit, a driving unit configured to generate a driving force for the pressing unit to reciprocate in the transport direction and the reverse transport direction, and a control unit configured to control the driving unit, wherein the pressing unit is separated from the adhesive layer along with reciprocation in the transport direction and the reverse transport direction, and the control unit is configured to detect a load of the driving unit, and determines a magnitude of an adhesive force of the adhesive layer, based on the load.

According to the present aspect, similarly to the first aspect, the magnitude of the adhesive force of the adhesive layer can be determined, and thus the adhesive force of the adhesive layer can be controlled. With this, when the ejection unit ejects the liquid onto the medium, position deviation of the medium with respect to the transport belt can be suppressed. Thus, deviation of the ejection position of the liquid with respect to the medium can be suppressed.

A liquid ejection device according to an eleventh aspect includes an ejection unit configured to eject a liquid onto a medium, a transport belt including an adhesive layer and configured to transport the medium caused to adhere to the adhesive layer, a pressing unit that is provided movably in an intersecting direction intersecting with a transport direction in which the medium is transported and that is configured to press the medium against the adhesive layer, the pressing unit being configured to come into contact with the adhesive layer at at least a part of the pressing unit, a second driving unit configured to generate a driving force for the pressing unit to move in the intersecting direction, and a control unit configured to control the other driving unit, wherein the pressing unit is separated from the adhesive layer along with movement in the intersecting direction, and the control unit is configured to detect a load of the other driving unit, and determines a magnitude of an adhesive force of the adhesive layer, based on the load.

According to the present aspect, similarly to the eighth aspect, the magnitude of the adhesive force of the adhesive layer can be determined, and thus the adhesive force of the adhesive layer can be managed. With this, when the ejection unit ejects the liquid onto the medium, position deviation of the medium with respect to the transport belt can be suppressed. Thus, deviation of the ejection position of the liquid with respect to the medium can be suppressed.

A liquid ejection device according to a twelfth aspect includes an ejection unit configured to eject a liquid onto a medium, a transport belt including an adhesive layer and configured to transport the medium caused to adhere to the adhesive layer, a pressing unit that is provided reciprocably in a transport direction in which the medium is transported and a reverse transport direction opposite to the transport direction and that is configured to press the medium against the adhesive layer, the pressing unit being configured to come into contact with the adhesive layer at at least a part of the pressing unit, a regulation unit configured to regulate reciprocation of the pressing unit, and a control unit configured to control the regulation unit, wherein the pressing unit is configured to be separated from the adhesive layer along with movement of the transport belt, and the control unit is configured to detect a load acting on the regulation unit when the regulation unit regulates the reciprocation of the pressing unit, and determines a magnitude of an adhesive force of the adhesive layer, based on the load.

According to the present aspect, similarly to the ninth aspect, the magnitude of the adhesive force of the adhesive layer can be determined, and thus the adhesive force of the adhesive layer can be controlled. With this, when the ejection unit ejects the liquid onto the medium, position deviation of the medium with respect to the transport belt can be suppressed. Thus, deviation of the ejection position of the liquid with respect to the medium can be suppressed.

First Exemplary Embodiment

A printer 10 and a transport unit 40 according to a first exemplary embodiment of the present disclosure are specifically described below.

As illustrated in FIG. 1, the printer 10 is an example of a liquid ejection device that performs recording by ejecting an ink K, which is an example of a liquid, onto a medium M. The printer 10 is installed on a floor 2 in a factory 1. The printer 10 causes a recording unit 30, which is described later, to perform recording on the medium M.

The medium M is an example of a recording medium on which an image is recorded. Examples of the medium M include fabrics or paper. In addition, the medium M is drawn out from the front of the printer 10 as an example. Note that an X-Y-Z coordinate system illustrated in each of the drawings is an orthogonal coordinate system.

An X-direction is a device width direction of the printer 10, and is a horizontal direction. A leading-end side of an arrow indicating the X-direction is defined as a +X-direction, and a base-end side of the arrow indicating the X-direction is defined as a-X-direction. In addition, the X-direction is an example of the width direction of the medium M. A Y-direction is a depth direction of the printer 10, and is a horizontal direction. A leading-end side of an arrow indicating the Y-direction is defined as a +Y-direction, and a base-end side of the arrow indicating the Y-direction is defined as a −Y-direction. The +Y-direction is an example of a transport direction in which the medium M is transported. The −Y direction is an example of a reverse transport direction opposite to the +Y-direction.

A Z-direction is an example of a height direction of the printer 10. Further, the Z-direction is an example of an intersecting direction intersecting with the Y-direction. A leading-end side of an arrow indicating the Z-direction is defined as a +Z-direction, and a base-end side of the arrow indicating the Z-direction is defined as a −Z-direction. The −Z-direction is a direction along which the gravity acts. The intersecting direction is a direction intersecting an outer circumferential surface 42A of a glue belt 42, which is described later.

Figure 2:
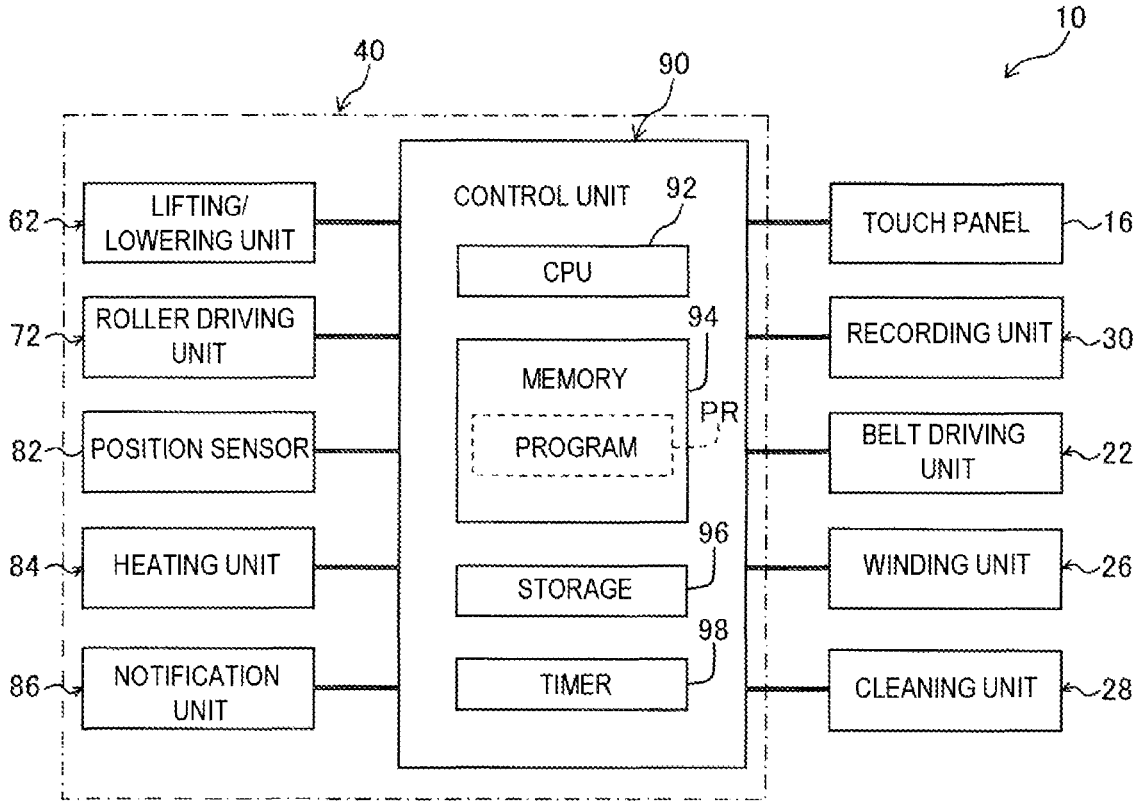
FIG. 2 is a block diagram of the printer according to the first exemplary embodiment.

As illustrated in FIG. 1 and FIG. 2, as an example, the printer 10 includes a device main body 12, a main body cover 14, a touch panel 16, a belt driving unit 22, a winding unit 26, a cleaning unit 28, the recording unit 30, and the transport unit 40.

The device main body 12 is configured as a base portion provided with each of the units of the printer 10.

The main body cover 14 is an exterior member that covers each of the units of the printer 10.

The touch panel 16 is configured to input settings and operations of the actions of the respective units of the printer 10.

The belt driving unit 22 is configured to include a driving roller 24, a driven roller 25, and a motor, which is not illustrated, for rotating the driving roller 24.

The driving roller 24 is arranged downstream in the +Y-direction in the device main body 12. The driven roller 25 is arranged upstream in the +Y-direction. Each of the driving roller 24 and the driven roller 25 includes a rotation shaft along the X-direction. The rotation of the driving roller 24 is controlled by a control unit 90, which is described later.

The winding unit 26 is configured to include a motor and a roller, which are not illustrated. The winding unit 26 winds the medium M after recording. In other words, the winding unit 26 peels off the medium M from the glue belt 42, which is described later, while applying a tension to the medium M after recording.

As an example, the cleaning unit 28 includes a brush roller 29 that is provided in a rotatable manner and comes into contact with the glue belt 42. The cleaning unit 28 removes foreign materials and the like that adhere to the glue belt 42 from which the medium M peels off.

As illustrated in FIG. 1, the recording unit 30 is provided in the device main body 12. Further, the recording unit 30 performs recording on the medium M that moves in the +Y-direction using the ink K. Specifically, the recording unit 30 includes a recording head 32 and a carriage 34 that supports the recording head 32.

The carriage 34 is configured to include a motor and the like, which are not illustrated, and supports the recording head 32. Further, the carriage 34 is configured to reciprocate the recording head 32 in the X-direction.

The recording head 32 includes a plurality of nozzles, which are not illustrated, and is arranged in the +Z-direction with respect to the glue belt 42, which is described later. The recording head 32 is an example of an ejection unit capable of ejecting the ink K onto the medium M. Note that the recording head 32 ejects an ink droplet Q as an example of a liquid droplet of the ink K. The recording head 32 ejects the ink droplet Q onto the medium M, and thus performs recording of an image on the medium M.

The transport unit 40 is an example of a transport device that transports the medium M. The transport unit 40 includes the glue belt 42, a pressurizing roller 46, a lifting/lowering unit 62, a roller driving unit 72, a position sensor 82, a heating unit 84, and a notification unit 86 (FIG. 2), and the control unit 90.

The glue belt 42 is an example of a transport belt capable of transporting the medium M, and is configured as an endless belt obtained by joining both ends of a flat plate having elasticity. In other words, the glue belt 42 is a cylindrical belt member. As an example, the glue belt 42 is a rubber belt.

Further, the glue belt 42 is wound around the driving roller 24 and the driven roller 25. In this manner, the glue belt 42 is provided in the device main body 12, and is capable of transporting the medium M in the +Y-direction by being circularly moved. The circumferential direction of the glue belt 42 is a +R-direction. The glue belt 42 includes an outer circumferential surface 42A.

Figure 5:
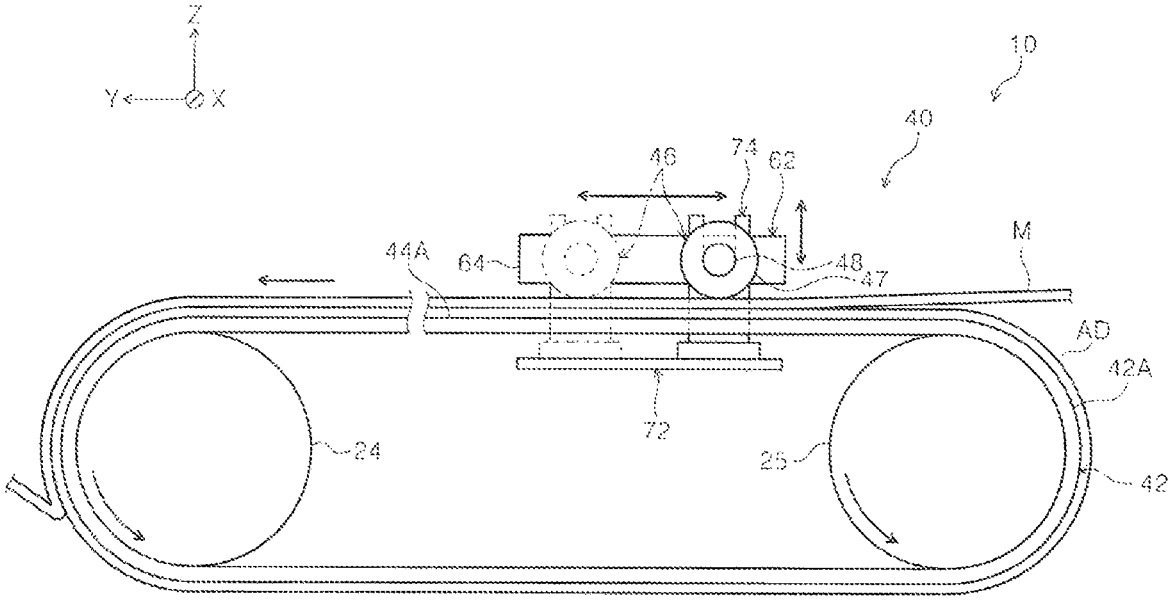
FIG. 5 is a schematic view illustrating a state in which an adhesive force of a glue belt is measured in the printer according to the first exemplary embodiment.

As illustrated in FIG. 5, the outer circumferential surface 42A is applied with an adhesive material, and thus is provided with an adhesive layer AD. In other words, the glue belt 42 includes the adhesive layer AD. Further, the glue belt 42 transports, in the +Y-direction, the medium M that is caused by the pressurizing roller 46 to adhere to the adhesive layer AD. Note that the term adhesiveness refers to a property of being capable of temporarily adhering to other members and peeling off from an adhesion state. Further, the surface of the adhesive layer AD functions as the outer circumferential surface 42A.

As illustrated in FIG. 1, on the outer circumferential surface 42A, a part which is positioned in the +Z-direction from the center of the driving roller 24 and along an X-Y plane is an upper surface portion 44A. The upper surface portion 44A supports the medium M. In the outer circumferential surface 42A, a part wound around the driving roller 24 is a curved surface portion 44B. In the outer circumferential surface 42A, a part which is positioned in the Z-direction from the center of the driving roller 24 and along the X-Y plane is a lower surface portion 44C. In the outer circumferential surface 42A, a part wound around the driven roller 25 is a curved surface portion 44D.

The pressurizing roller 46 is provided at a position facing an end in the +Z-direction, the end being an end of the upper surface portion 44A in the −Y-direction.

The pressurizing roller 46 is an example of a pressing unit that presses the medium M against the adhesive layer AD (FIG. 5) while reciprocating in the +Y-direction and the −Y-direction. Specifically, the pressurizing roller 46 is provided rotatably about an axis along the X-direction. Further, the pressurizing roller 46 is driven by the roller driving unit 72 (FIG. 2), which is described later, to reciprocate in the +Y-direction and the −Y-direction. The pressurizing roller 46 is positioned upstream of the recording unit 30 in the +Y-direction.

Figure 4:
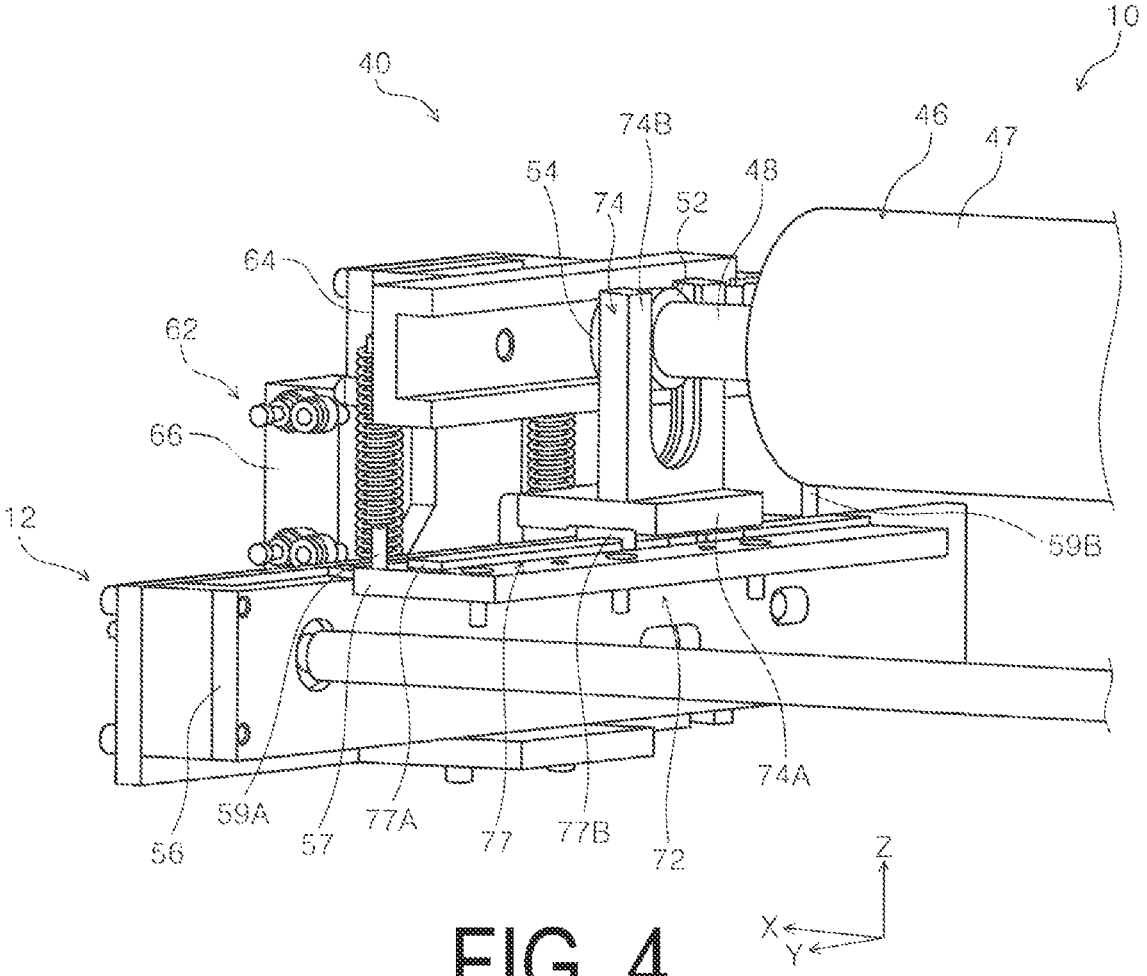
FIG. 4 is a perspective view illustrating the other of the roller driving unit and the lifting/lowering unit of the printer according to the first exemplary embodiment.

As described in FIG. 4, the pressurizing roller 46 includes a cylindric elastic portion 47 and a cylindric shaft portion 48 that passes through the elastic portion 47 in the X-direction.

The length of the elastic portion 47 in the X-direction is larger than the length of the medium M in the X-direction, the medium M having a maximum size of the sizes that can be used in the printer 10. In other words, even in a state in which the pressurizing roller 46 is in contact with the medium M, at least a part thereof in the X-direction is capable of coming into contact with the adhesive layer AD (FIG. 5). Further, the pressurizing roller 46 may be rotated along with reciprocation in the +Y-direction and the −Y-direction in some cases. In other words, the pressurizing roller 46 translates or rolls, and thus is capable of being separated from the adhesive layer AD.

At each of the ends of the shaft portion 48 in the X-direction, a first bearing 52 and a second bearing 54 are provided.

The first bearing 52 is a guided portion for lifting and lowering the pressurizing roller 46 in the +Z-direction and the −Z-direction.

The second bearing 54 is a guided portion for reciprocating the pressurizing roller 46 in the +Y-direction and the −Y-direction.

The pressurizing roller 46 is capable of changing a pressing force FR [N] when pressing the medium M against the glue belt 42 (FIG. 1) by being lifted or lowered by the lifting/lowering unit 62, which is described later, in the Z-direction. Specifically, when the position of the pressurizing roller 46 in the Z-direction is lifted in the +Z-direction by the lifting/lowering unit 62, the pressurizing roller 46 is away from the medium M. With this, the pressing force FR acting on the medium M is reduced. When the position of the pressurizing roller 46 in the Z-direction is lowered in the −Z-direction by the lifting/lowering unit 62, the contact area with the medium M is increased. As the area increases, the pressing force FR acting on the medium M is increased. Note that the pressing force FR is omitted in illustration. Further, the pressurizing roller 46 includes the heating unit 84 (FIG. 2), which is described later.

The device main body 12 includes side frames 56 that support the pressurizing roller 46. The side frames 56 are positioned in the +X-direction and the −X-direction from the center of the device main body 12. A base 57 extending in the Y-direction is mounted to the side frame 56. A linear guide 77 extending in the Y-direction is provided to the base 57. Further, the base 57 is provided with regulation pins 59A and 59B that regulate a moving range of the guide member 74, which is described later, in the Y-direction.

The lifting/lowering unit 62 is included as an example of the pressing unit together with the pressurizing roller 46. As an example, the lifting/lowering unit 62 includes a guide rail 64 and an air cylinder 66.

The guide rail 64 extends in the Y-direction. The guide rail 64 has a U-like cross-sectional shape opened in the +X-direction or the −X-direction. The guide rail 64 supports and guides the second bearing 54 and the pressurizing roller 46 so that the second bearing 54 reciprocates in the Y-direction.

The air cylinder 66 lifts or lowers the guide rail 64 from one of the +Z-direction and the −Z-direction to the other thereof. Movement of the guide rail 64 in the Z-direction is substantially parallel movement. An operation of the air cylinder 66 is controlled by the control unit 90 (FIG. 2), which is described later. When the air cylinder 66 lifts the guide rail 64 in the +Z-direction, the position of the pressurizing roller 46 is lifted in the +Z-direction. When the air cylinder 66 lowers the guide rail 64 in the −Z-direction, the position of the pressurizing roller 46 is lowered in the −Z-direction.

Figure 3:
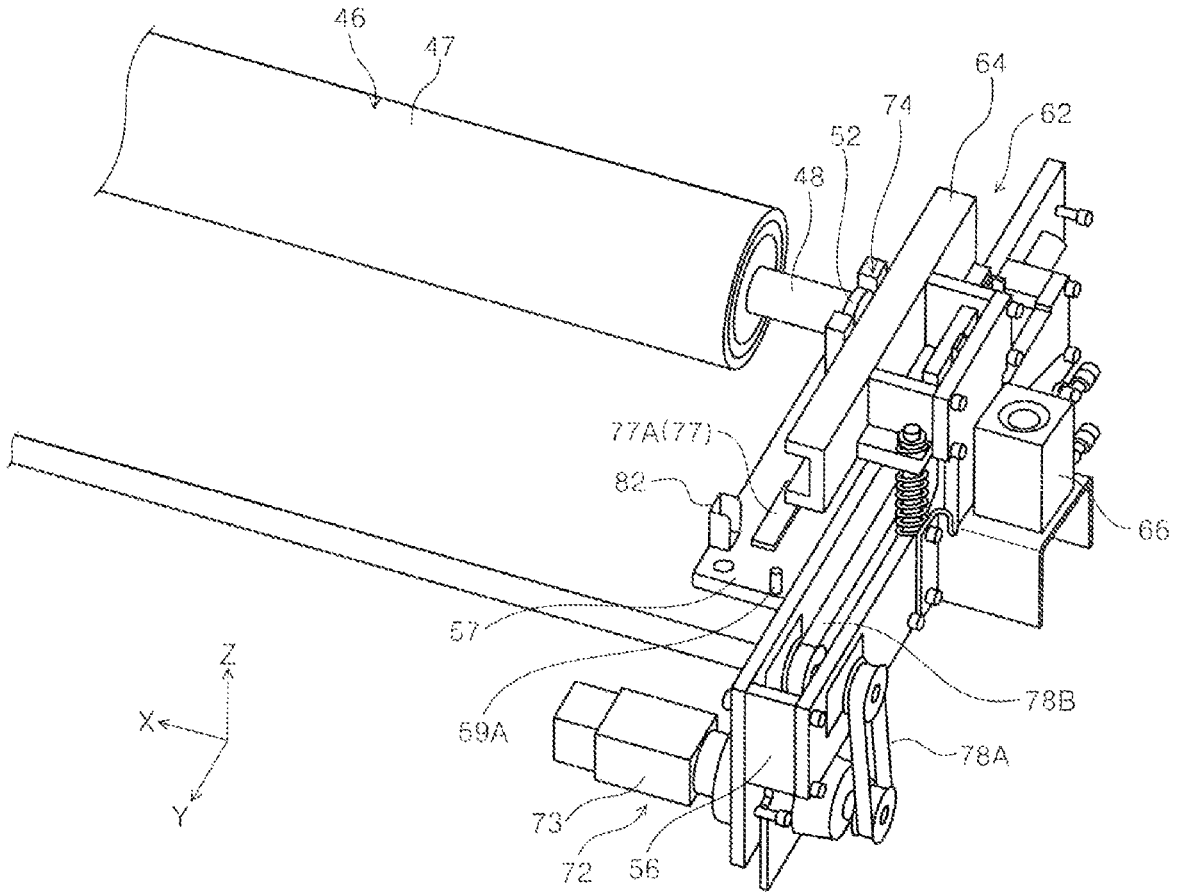
FIG. 3 is a perspective view illustrating one of a roller driving unit and a lifting/lowering unit of the printer according to the first exemplary embodiment.

As illustrated in FIG. 3, the roller driving unit 72 is an example of a driving unit that generates a driving force for the pressurizing roller 46 to reciprocate in the +Y-direction and the −Y-direction. The roller driving unit 72 is controlled by the control unit 90 (FIG. 2), which is described later. As an example, the roller driving unit 72 is configured to include a motor 73, the guide member 74, the linear guide 77, and transmission belts 78A and 78B.

The motor 73 generates a driving force for the guide member 74 to move in the Y-direction.

The transmission belt 78B extends along the Y-direction. The transmission belts 78A and 78B transmit a driving force of the motor 73 to the guide member 74 via a plurality of pulleys.

As illustrated in FIG. 4, as an example, the guide member 74 includes a base portion 74A and an erect portion 74B. The base portion 74A is formed of a plate-lie member having a predetermined thickness in the Z-direction. A part of the base portion 74A is coupled to the transmission belt 78B (FIG. 3) via a coupling portion, which is not illustrated. In other words, as the transmission belt 78B moves in the Y-direction, the guide member 74 is moved in the Y-direction.

The erect portion 74B erects from the base portion 74A in the +Z-direction. Further, as viewed in the X-direction, the erect portion 74B has a U-like outer shape opened in the +Z-direction. A U-like facing inner surface 74C of the erect portion 74B forms a guiding surface that guides the first bearing 52 in the Z-direction.

The linear guide 77 includes a guide rail 77A and a movable portion 77B.

The guide rail 77A is mounted to the base 57, and extends in the Y-direction.

The movable portion 77B is mounted to the end of the base portion 74A in the −Z-direction. The movable portion 77B is guided by the guide rail 77A in the Y-direction.

In this manner, the roller driving unit 72 drives the guide member 74 so that the pressurizing roller 46 reciprocates in the +Y-direction and the −Y-direction.

As illustrated in FIG. 3, the position sensor 82 is positioned in the +X-direction with respect to the end of the guide rail 77A in the +Y-direction. As an example, the position sensor 82 is formed of a sensor of an optical and reflection type. The position sensor 82 detects presence or absence of the guide member 74. In other words, the position sensor 82 detects the guide member 74, which indicates that the pressurizing roller 46 is positioned at the end in the +Y-direction within a movement region. The position sensor 82 measures a time period from the detection of the guide member 74 to the subsequent detection of the guide member 74 using a timer 98 (FIG. 2). With this, a time period one reciprocation of the pressurizing roller 46 is measured.

As illustrated in FIG. 2, a heating operation of the heating unit 84 is controlled by the control unit 90, which is described later. As an example, the heating unit 84 is configured to include a halogen heater, which is not illustrated. The halogen heater is provided inside the shaft portion 48 (FIG. 3). The heating unit 84 is supplied with power from a power source, which is not illustrated, so that the halogen heater generates heat, and thus heats the pressurizing roller 46 (FIG. 3). In other words, the heating unit 84 is capable of heating the medium M via the pressurizing roller 46.

The notification unit 86 is capable of issuing a notification relating to information. Presence or absence of a notification relating to information is determined by the control unit 90. As an example, the notification unit 86 is configured to include a speaker, and issues a notification relating to information by generating a voice sound. Note that a notification relating to information may be issued by generating a sound instead of a voice sound. Further, the notification unit 86 and the touch panel 16 may be combined to cause the touch panel 16 to display a part of information, and thus a visually recognizable notification may be issued.

As an example, the control unit 90 includes a Central Processing Unit (CPU) 92 that functions as a computer, a memory 94, a storage 96, and the timer 98. In a part of the memory 94, a program PR can be developed. The control unit 90 executes the program PR, and thus controls operations of the transport unit 40. Note that, in the present exemplary embodiment, as an example, the control unit 90 controls operations such as recording, discharging, and cleaning in the respective units of the printer 10, in addition to control of the transport unit 40.

With reference to FIG. 2, FIG. 3, and FIG. 5, each control of the control unit 90 is described.

The control unit 90 is capable of detecting a load T[N·m] of the roller driving unit 72. Specifically, the control unit 90 detects a change of the load T acting on the motor 73, based on a change of a current value I[A] required for driving the motor 73. The load T acting on the motor 73 is a load that acts when the pressurizing roller 46 is moved the Y-direction via the guide member 74. When the adhesive force F[N] of the adhesive layer AD (FIG. 5) is strong, the load T acting for moving the pressurizing roller 46 in the Y-direction is increased. When the adhesive force F is weak, the load T is reduced. Note that the load T and the current value I are omitted in illustration.

Figure 6:
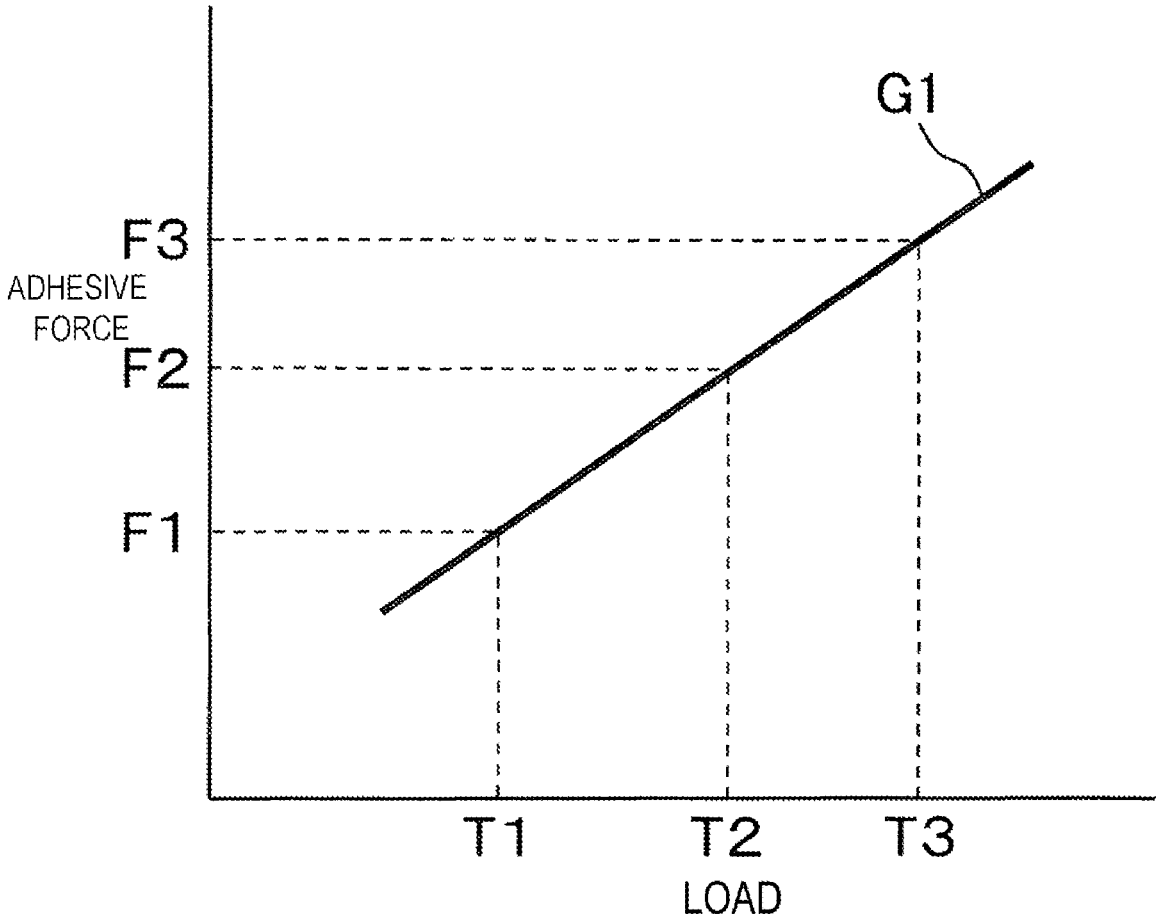
FIG. 6 is a graph showing a relationship between a load acting on a motor and the adhesive force of the glue belt in the printer according to the first exemplary embodiment.

FIG. 6 gives a graph G1 showing a relationship between the load T and the adhesive force F at the time of translation, that is, separation of the pressurizing roller 46. An adhesive force at a load T1 is an adhesive force F1, an adhesive force at a load T2 is an adhesive force F2, and an adhesive force at a load T3 is an adhesive force F3. The magnitudes of the loads T1, T2, and T3 are expressed as T1<T2<T3. The magnitudes of the adhesive forces F1, F2, and F3 are expressed as F1<F2<F3. In this manner, as the adhesive force F is increased, the load T is increased.

As illustrated in FIG. 2, FIG. 3, and FIG. 5, the control unit 90 is capable of determining the magnitude of the adhesive force F of the adhesive layer AD, based on the load T of the motor 73. In the present exemplary embodiment, the adhesive force F2 is set as an example of a target value. In other words, the control unit 90 determines whether the magnitude of the adhesive force F is less than F2, based on whether the load T of the motor 73 is less than T2.

The control unit 90 is capable of detecting the load T of the roller driving unit 72 while circularly moving the glue belt 42 in the +R-direction.

When it is determined that the magnitude of the adhesive force F is less than the target value F2, the control unit 90 controls the lifting/lowering unit 62 to increase the pressing force FR. Specifically, when the adhesive force F is less than F2, the control unit 90 operates the air cylinder 66 so that the position of the guide rail 64 and the position of the pressurizing roller 46 are lowered in the −Z-direction. Further, when the adhesive force F is greater than F2, the control unit 90 operates the air cylinder 66 so that the position of the guide rail 64 and the position of the pressurizing roller 46 are lifted in the +Z-direction.

When it is determined that the magnitude of the adhesive force F is less than the target value F2, the control unit 90 increases an output of the heating unit 84 to increase a temperature of the medium M. In other words, the control unit 90 causes the heating unit 84 to heat the pressurizing roller 46 to increase a temperature of the adhesive layer AD.

Note that, in the present exemplary embodiment, a temperature range in which the heating unit 84 performs heating is limited. In the temperature range, the adhesive force F of the adhesive layer AD tends to be increased as temperature increases. When a temperature is excessively increased, the adhesive layer AD flows to reduce. Thus, the temperature range is limited.

When it is determined that the magnitude of the adhesive force F is less than the target value F2, the control unit 90 causes the notification unit 86 to issue a notification relating to information indicating reduction in the magnitude of the adhesive force F. As an example, the notification unit 86 issues a notification by generating a voice sound indicating a message "the adhesive force is reduced". Note that, in the present exemplary embodiment, as described above, when the magnitude of the adhesive force F is less than the target value F2, the processing of increasing an output of the heating unit 84 is executed. Thus, a notification issued by the notification unit 86 is used for calling an attention.

As a modified example, when the magnitude of the adhesive force F is less than the target value F2, an operation of each of the units of the printer 10 may be stopped while the notification unit 86 issues a notification. In this case, when a user applies an adhesive material onto the outer circumferential surface 42A to form a new adhesive layer AD. With this, the adhesive force F can be secured. Further, when the magnitude of the adhesive force F is less than the target value F2, a user may set whether to stop an operation of each of the units of the printer 10.

The control unit 90 is capable of executing a determination mode in which the adhesive force F is determined based on the load T and a transport mode in which the medium M is transported after the determination mode. In the determination mode, when the pressurizing roller 46 reciprocates in the Y-direction, a speed of the pressurizing roller 46 is a first speed V1 [m/s]. Further, in the transport mode, when the pressurizing roller 46 reciprocates in the Y-direction, a speed of the pressurizing roller 46 is a second speed V2 [m/s]. As an example, the first speed V1 and the second speed V2 are each set as an average speed.

Here, the control unit 90 is capable of controlling the roller driving unit 72 so that the first speed V1 is higher than the second speed V2. Note that the adhesive force F, the first speed V1, and the second speed V2 are omitted in illustration.

Next, actions of the printer 10 and the transport unit 40 are described. Note that FIG. 1 to FIG. 6 are referred to for each of the configurations, and the individual drawing numbers may be omitted in description in some cases.

Figure 7:
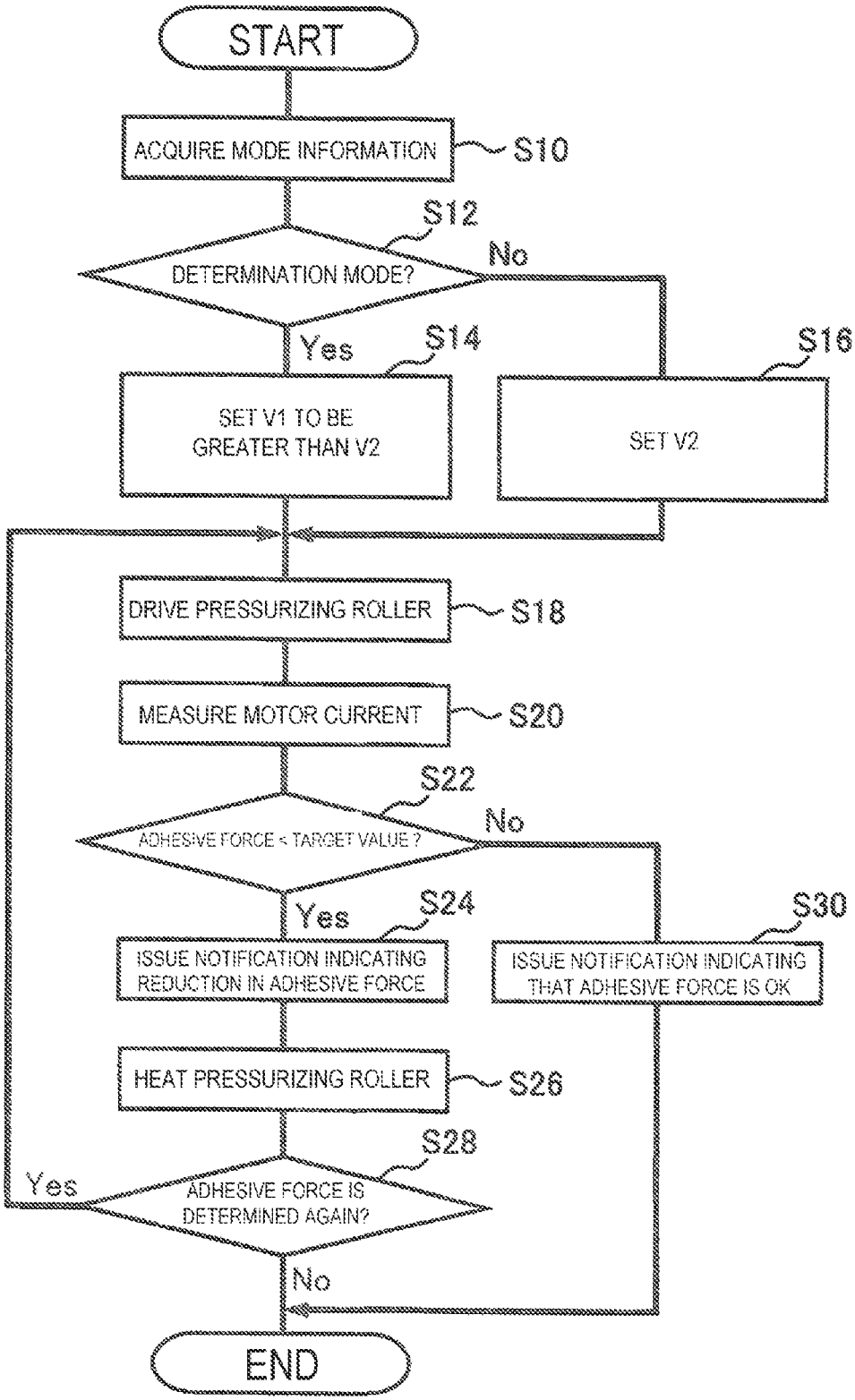
FIG. 7 is a flowchart illustrating a flow of each processing executed in the printer according to the first exemplary embodiment.

FIG. 7 is a flowchart illustrating a flow of each processing executed in the transport unit 40, the processing being executed by the control unit 90 when the printer 10 is in an operable state as a trigger. Each processing in FIG. 7 is executed when the CPU 92 reads out the program PR from the memory 94, develops the program PR, and executes the program PR.

In Step S10, the CPU 92 acquires information obtained by operating the touch panel 16 or information transmitted from a computer, which is not illustrated, as mode information relating to an operation of the printer 10. Then, the processing proceeds to Step S12.

In Step S12, the CPU 92 determines whether the determination mode is set. When the determination mode is set (Yes in Step S12), the processing proceeds to Step S14. When the determination mode is not set (No in Step S12), that is, the transport mode is set, the processing proceeds to Step S16.

In Step S14, the CPU 92 sets the first speed V1 so that the first speed V1 is higher than the second speed V2. Then, the processing proceeds to Step S18.

In Step S16, the CPU 92 sets the second speed V2. Then, the processing proceeds to Step S18. Note that the second speed V2 may be set in a step other than Step S16, that is, for example, a step between Step S10 and Step S12 or a step before Step S10.

In Step S18, the CPU 92 controls an operation of the roller driving unit 72 to drive the pressurizing roller 46 in the Y-direction. Then, the processing proceeds to Step S20. In Step S20, the CPU 92 measures a current of the motor 73. Then, the processing proceeds to Step S22.

In Step S22, the CPU 92 detects the load T, based on the obtained current value of the motor 73, and obtains the adhesive force F, based on the load T. Further, the CPU 92 determines whether the obtained adhesive force F is less than the target value F2. When the adhesive force F is less than the target value F2 (Yes in Step S22), the processing proceeds to Step S24. When the adhesive force F is equal to or greater than the target value F2 (No in Step S22), the processing proceeds to Step S30.

In Step S24, the CPU 92 causes the notification unit 86 to issue a notification indicating reduction in the adhesive force F. Then, the processing proceeds to Step S26.

In Step S26, the CPU 92 increases an output of the heating unit 84 to increase a temperature of the medium M. In other words, the CPU 92 causes the heating unit 84 to heat the pressurizing roller 46 to increase a temperature of the adhesive layer AD. Then, the processing proceeds to Step S28.

In Step S28, the CPU 92 determines whether determination of the adhesive force F is executed again. For example, the determination is executed based on necessity of "re-determination of the adhesive force F" that is set advance through the touch panel 16. When the adhesive force F is not determined again (No in Step S28), the program PR is terminated. When the adhesive force F is determined again (Yes in Step S28), the processing proceeds to Step S18. In Step S28, whether to execute re-determination of the adhesive force F may be selected by a user through the touch panel 16. Further, in Step S28, the CPU 92 may cause the notification unit 86 or the touch panel 16 to notify a user of a message relating to necessity of "re-determination of the adhesive force F".

In Step S30, the CPU 92 causes the notification unit 86 to issue a notification indicating that the adhesive force F is OK. Then, the program PR is terminated.

Note that, in the printer 10, the glue belt 42 is circularly moved, and thus the medium M is transported. The recording unit 30 performs recording on the medium M being transported. At this state, after the processing described above, the adhesive force F of the adhesive layer AD is controlled, and thus position deviation of the medium M with respect to the glue belt 42 can be suppressed. With this, deviation of a position at which the ink droplet Q arrives at the medium M can be suppressed.

The medium M after recording peels off from the glue belt 42. After the medium M peels off from the glue belt 42, the cleaning unit 28 performs cleaning on the outer circumferential surface 42A.

As described above, according to the transport unit 40, at least a part of the pressurizing roller 46 is in contact with the adhesive layer AD. Further, the pressurizing roller 46 is driven by the roller driving unit 72, and thus presses the medium M against the adhesive layer AD while reciprocating in the +Y-direction and the −Y-direction. At this state, the pressurizing roller 46 repeatedly comes into contact with and is separated from the adhesive layer along with reciprocation.

Here, the control unit 90 determines whether the magnitude of the adhesive force F of the adhesive layer AD is less than the target value F2, based on the load T of the roller driving unit 72. For example, when the load T1 smaller than the predetermined load T2 acts on the roller driving unit 72, the control unit 90 determines that the magnitude of the adhesive force F of the adhesive layer AD is less than the target value F2. In this manner, the load T acting on the pressurizing roller 46 coming into contact with the adhesive layer AD is directly detected, and thus an influence due to slippage of the glue belt 42 or the like can be suppressed as compared to a configuration of detecting driving of the glue belt 42. Thus, the magnitude of the adhesive force F can be determined at a high accuracy.

Note that the adhesive force F can be secured by forming a new adhesive layer AD with a method of applying an adhesive material onto the glue belt 42 or the like.

According to the transport unit 40, the load T of the roller driving unit 72 is detected while circularly moving the glue belt 42. Thus, the adhesive force F can be determined at a plurality of positions of the glue belt 42 in the circumferential direction.

According to the transport unit 40, when the magnitude of the adhesive force F is small, a pressing force generated by the pressurizing roller 46 is increased, and thus the contact area between the medium M and the adhesive layer AD is increased. With this, the adhesive force F acting on the medium M can be secured, and thus position deviation of the medium M with respect to the glue belt 42 can be suppressed.

According to the transport unit 40, when the magnitude of the adhesive force F is reduced, an output of the heating unit 84 is increased. With this, a temperature of the medium M is increased, and a temperature of the adhesive layer AD is also increased. With this, the adhesive force of the adhesive layer AD with respect to the medium M can be increased.

According to the transport unit 40, the first speed V1 is higher than the second speed V2, and thus a time period during which the pressurizing roller 46 is in contact with the adhesive layer AD is reduced. With this, removal of a part of the adhesive layer AD by the pressurizing roller 46 can be suppressed, and thus degradation of adhesiveness of the medium M with respect to the glue belt 42 can be suppressed.

According to the transport unit 40, the notification unit 86 issues a notification relating to the information indicating reduction in the magnitude of the adhesive force F, and hence a user is easily allowed to grasp a condition of the adhesive force F.

Similarly to the transport unit 40, according to the printer 10, the magnitude of the adhesive force F of the adhesive layer AD can be determined, and thus the adhesive force F of the adhesive layer AD can be controlled. With this, when the recording head 32 ejects the ink K onto the medium M, position deviation of the medium M with respect to the glue belt 42 can be suppressed. Thus, deviation of the ejection position of the ink K with respect to the medium M can be suppressed.

Modified Example of First Exemplary Embodiment

A modified example of the printer 10 and the transport unit 40 according to the first exemplary embodiment is described below. Note that the same configurations as those of the printer 10 and the transport unit 40 according to the first exemplary embodiment are denoted with the same reference symbols. The description therefor is omitted, and the individual drawing numbers are also omitted in description.

In the modified example of the transport unit 40 (FIG. 2), the control unit 90 is capable of executing the determination mode in which the adhesive force F is determined based on the load T and the transport mode in which the medium M is transported after the determination mode. Further, the control unit 90 is capable of controlling the roller driving unit 72 so that the first speed V1 is lower than the second speed V2. In other words, in the transport unit 40 in the modified example, a high/low relationship between the first speed V1 and the second speed V2 is opposite to that in the transport unit 40 of the first exemplary embodiment.

Next, actions of the transport unit 40 in a modified example are described.

Figure 8:
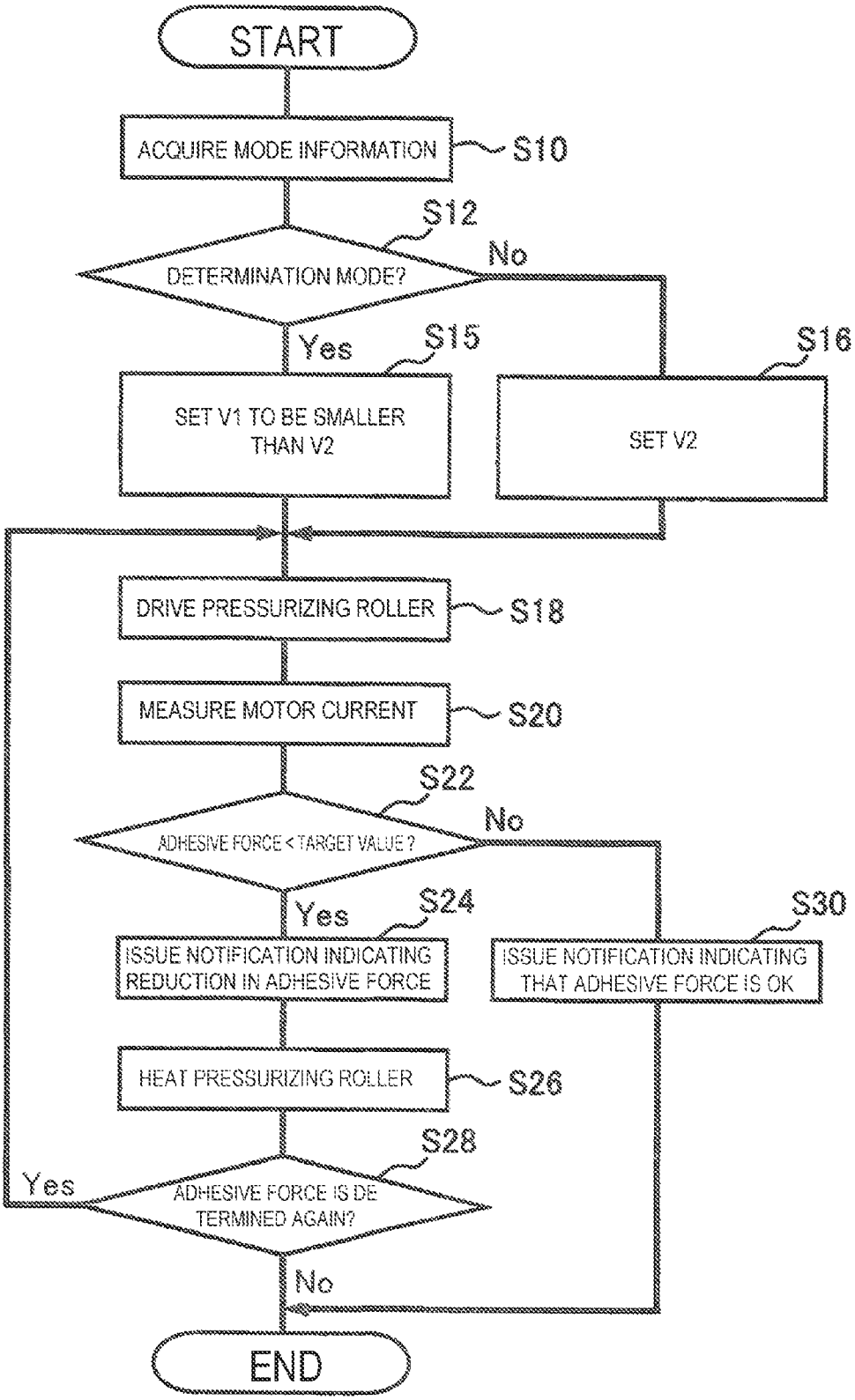
FIG. 8 is a flowchart illustrating a flow of each processing executed in a modified example relating to the printer according to the first exemplary embodiment.

FIG. 8 is a flowchart illustrating a flow of each processing executed in the transport unit 40 in the modified example, the processing being executed by the control unit 90 when the printer 10 is in an operable state as a trigger. Each processing in FIG. 8 is executed when the CPU 92 reads out the program PR from the memory 94, develops the program PR, and executes the program PR.

In the processing of the transport unit 40 in the modified example, Step S14 (FIG. 7) in the first exemplary embodiment is replaced with Step S15. The other steps are similar thereto. Thus, description is made on Step S15, and description for the other steps is omitted.

The processing proceeds to Step S15 when it is determined as Yes in Step S12. In Step S15, the CPU 92 sets the first speed V1 so that the first speed V1 is lower than the second speed V2. Then, the processing proceeds to Step S18.

In this manner, according to the transport unit 40 in the modified example, the first speed V1 is lower than the second speed V2, and thus a time period during which the pressurizing roller 46 is capable of coming into contact with the adhesive layer AD is increased. In other words, the number of times at which the pressurizing roller 46 comes into contact with the adhesive layer AD is increased. With this, even with a configuration in which there is variation in a gap between the pressurizing roller 46 and the adhesive layer AD, contact between the pressurizing roller 46 and the adhesive layer AD can be performed in a wide range. Thus, detection accuracy of the adhesive force F can be improved.

Second Exemplary Embodiment

The printer 10 and a transport unit 100 according to a second exemplary embodiment are specifically described below. Note that the same configurations as those of the printer 10 and the transport unit 40 according to the first exemplary embodiment are denoted with the same reference symbols, and the description therefor is omitted.

Figure 9:
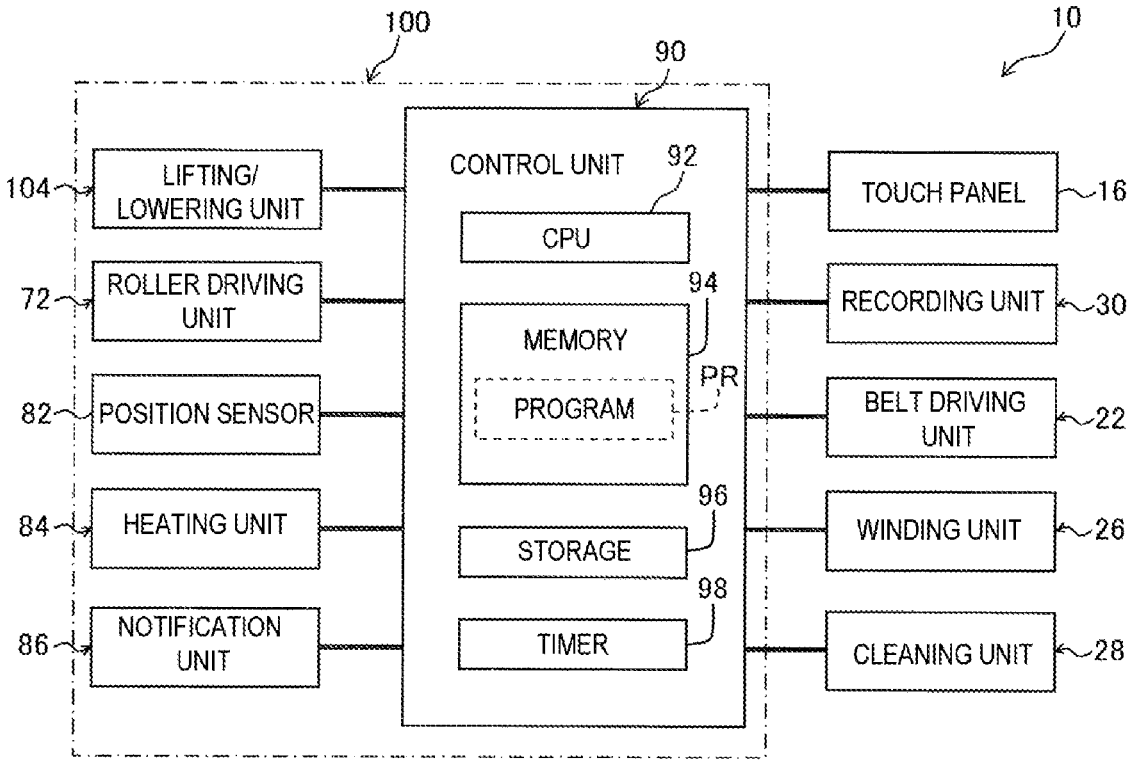
FIG. 9 is a block diagram of a printer according to a second exemplary embodiment.
Figure 10:
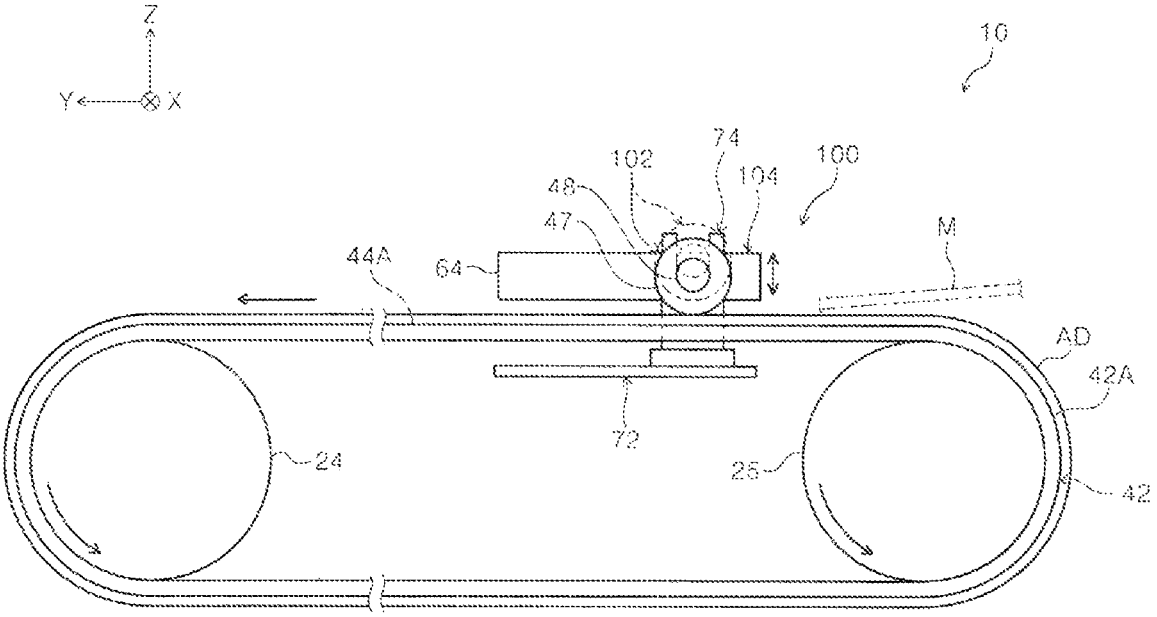
FIG. 10 is a schematic view illustrating a state in which an adhesive force of a glue belt is measured in the printer according to the second exemplary embodiment.

As illustrated in FIG. 9 and FIG. 10, the transport unit 100 is provided in place of the transport unit 40 (FIG. 2) in the printer 10. The configurations of the printer 10 other than the transport unit 100 are similar to those in the first exemplary embodiment.

The transport unit 100 includes a pressurizing roller 102 and a lifting/lowering unit 104 in place of the pressurizing roller 46 and the lifting/lowering unit 62 (FIG. 2) in the transport unit 40. The transport unit 100 is an example of a transport device that transports the medium M.

As illustrated in FIG. 10, the pressurizing roller 102 is provided at a position facing an end in the +Z-direction, the end being an end of the upper surface portion 44A in the −Y-direction.

The pressurizing roller 102 is an example of a pressing unit that presses the medium M against the adhesive layer AD. The pressurizing roller 102 can come into contact with the adhesive layer AD at at least a part in the X-direction, and is provided movably in the Z-direction intersecting with the +Y-direction in which the medium M is transported. Note that the pressurizing roller 102 is provided to be reciprocable also in the Y-direction.

Specifically, the pressurizing roller 102 is supported rotatably about an axis along the X-direction. Further, the pressurizing roller 102 is driven by the lifting/lowering unit 104, which is described later, to reciprocate in the +Z-direction and the −Z-direction. The pressurizing roller 102 is positioned upstream of the recording unit 30 (FIG. 1) in the +Y-direction. The pressurizing roller 102 includes the elastic portion 47 and the shaft portion 48.

The pressurizing roller 102 is capable of changing the pressing force FR [N] when pressing the medium M against the glue belt 42 by being lifted or lowered by the lifting/lowering unit 104 in the Z-direction.

Specifically, when the position of the pressurizing roller 102 in the Z-direction is lifted in the +Z-direction by the lifting/lowering unit 104, the pressurizing roller 102 is away from the medium M. With this, the pressing force FR acting on the medium M is reduced. In other words, the pressurizing roller 102 is separated from the adhesive layer AD along with movement in the +Z-direction.

Further, when the position of the pressurizing roller 102 in the Z-direction is lowered in the −Z-direction by the lifting/lowering unit 104, the contact area with the medium M is increased. As the area increases, the pressing force FR acting on the medium M is increased. Note that the pressing force FR is omitted in illustration.

The lifting/lowering unit 104 is an example of a second driving unit that generates a driving force for the pressurizing roller 102 to move in the Z-direction. The lifting/lowering unit 104 includes the guide rail 64 and the air cylinder 66 (FIG. 3). The lifting/lowering unit 104 is controlled by the control unit 90 (FIG. 9).

The control unit 90 is capable of detecting the load T of the lifting/lowering unit 104, and determines the magnitude of the adhesive force F of the adhesive layer AD, based on the load T. Note that, in the transport unit 100, the magnitude of the adhesive force F is determined in a state in which the medium M is not present.

Next, with reference to FIG. 9 and FIG. 10, actions of the printer 10 and the transport unit 100 according to the second exemplary embodiment are described.

According to the transport unit 100, the pressurizing roller 102 is driven by the lifting/lowering unit 104 to move in the −Z-direction being an example of one side of the intersecting direction. With this, the pressurizing roller 102 comes into contact with the adhesive layer AD.

Further, the pressurizing roller 102 is driven by the lifting/lowering unit 104 to move in the +Z-direction being an example of the other side in the intersecting direction. With this, the pressurizing roller 102 is separated from the adhesive layer AD.

Here, the control unit 90 determines whether the magnitude of the adhesive force F of the adhesive layer AD is less than the target value F2, based on the load T of the lifting/lowering unit 104, specifically, the load T at the time of separation of the pressurizing roller 102. For example, when the load T1 smaller than the predetermined load T2 acts on the lifting/lowering unit 104, the control unit 90 determines that the magnitude of the adhesive force F of the adhesive layer AD is less than the target value F2. In this manner, the load acting on the pressurizing roller 102 coming into contact with the adhesive layer AD is directly detected, and thus an influence due to slippage of the glue belt 42 or the like can be suppressed as compared to a configuration of detecting driving of the glue belt 42. Thus, the magnitude of the adhesive force F can be determined at a high accuracy.

According to the printer 10 of the second exemplary embodiment, similarly to the transport unit 100, the magnitude of the adhesive force F of the adhesive layer AD can be determined, and thus the adhesive force F of the adhesive layer AD can be controlled. With this, when the recording head 32 ejects the ink K onto the medium M, position deviation of the medium M with respect to the glue belt 42 can be suppressed. Thus, deviation of the ejection position of the ink K with respect to the medium M can be suppressed.

Third Exemplary Embodiment

The printer 10 and a transport unit 110 according to a third exemplary embodiment are specifically described below. Note that the same configurations as those of the printer 10 and the transport units 40 and 100 according to the first exemplary embodiment and the second exemplary embodiment are denoted with the same reference symbols, and the description therefor is omitted.

Figure 11:
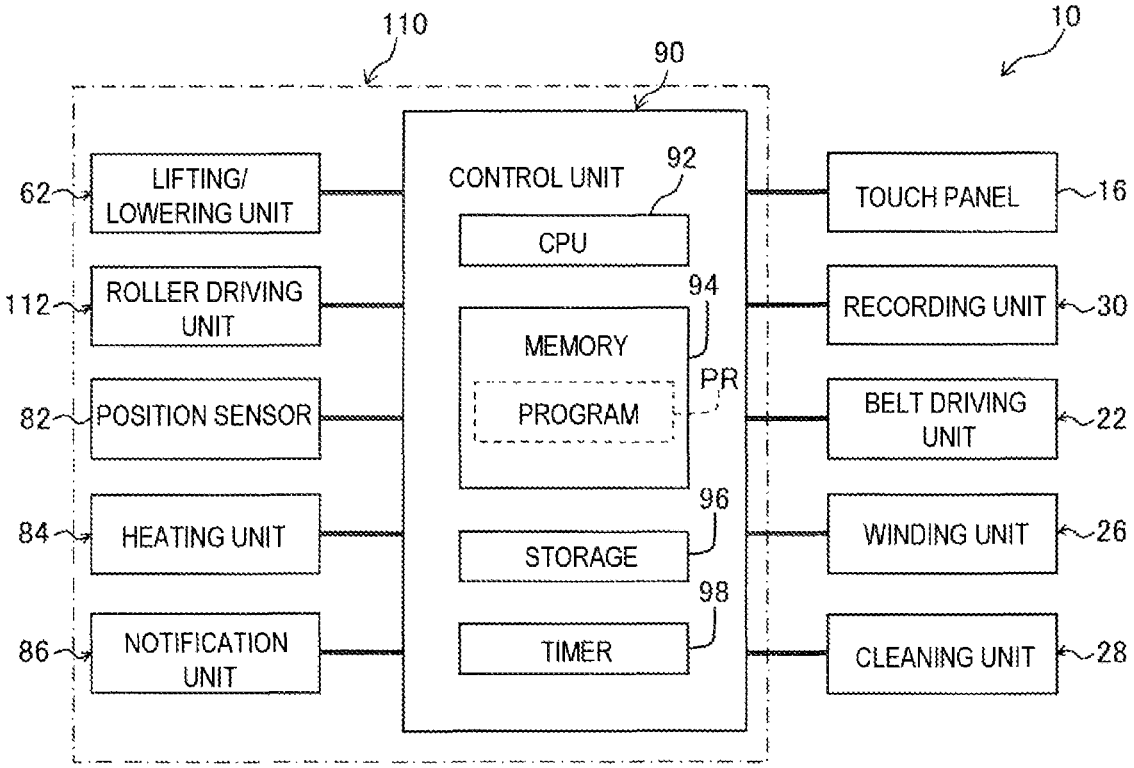
FIG. 11 is a block diagram of a printer according to a third exemplary embodiment.
Figure 12:
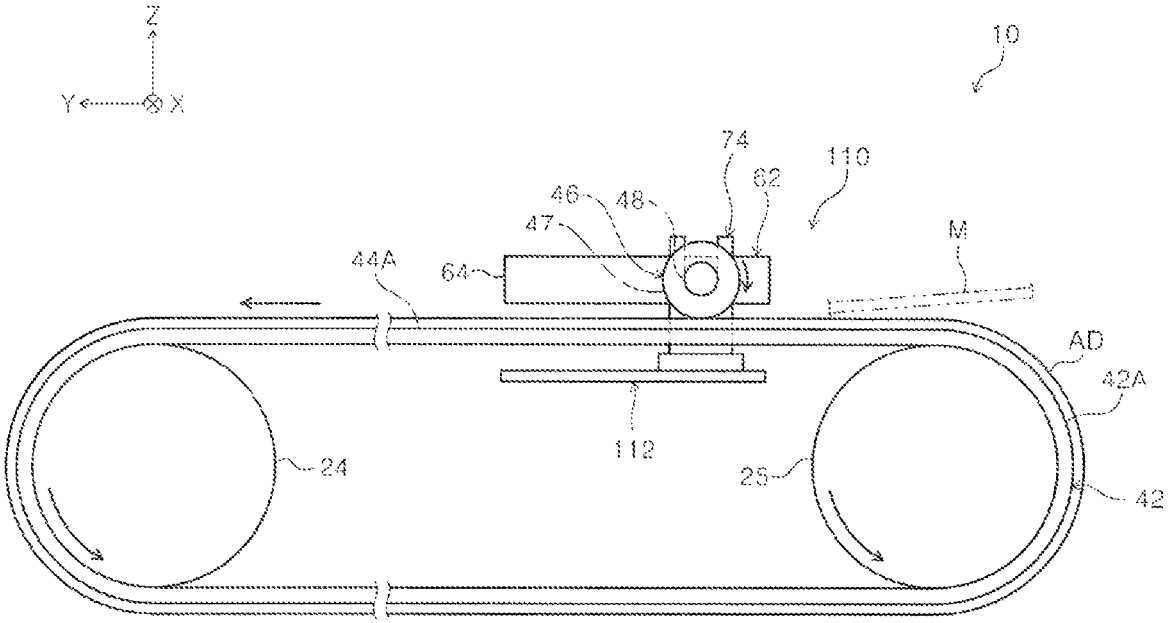
FIG. 12 is a schematic view illustrating a state in which an adhesive force of a glue belt is measured in the printer according to the third exemplary embodiment.

As illustrated in FIG. 11 and FIG. 12, the transport unit 110 is provided in place of the transport unit 40 (FIG. 2) in the printer 10. The configurations of the printer 10 other than the transport unit 110 are similar to those in the first exemplary embodiment.

The transport unit 110 is an example of a transport device that transports the medium M. The transport unit 110 includes the glue belt 42, the pressurizing roller 46, the lifting/lowering unit 62, a roller driving unit 112, and the control unit 90. Further, the transport unit 110 includes the position sensor 82, the heating unit 84, and the notification unit 86.

The pressurizing roller 46 is an example of a pressing unit that presses the medium M against the adhesive layer AD. The pressurizing roller 46 is driven by the roller driving unit 112, which is described later, to be reciprocable in the +Y-direction and the −Y-direction. In a state in which the roller driving unit 112 regulates movement, the pressurizing roller 46 is capable of being separated from the adhesive layer AD along with movement of the glue belt 42.

As an example, the roller driving unit 112 has a configuration similar to that of the roller driving unit 72 (FIG. 3). However, the roller driving unit 112 is different from the roller driving unit 72 in that the pressurizing roller 46 can be regulated at least from translating by causing an excitation current IA to flow to the motor 73 (FIG. 3). In other words, the roller driving unit 112 is an example of a regulation unit that regulates the pressurizing roller 46 from reciprocating in the Y-direction. The excitation current IA is omitted in illustration.

Further, the roller driving unit 112 is configured to be capable of generating a driving force for the pressurizing roller 46 to reciprocate in the +Y-direction and the −Y-direction. In this manner, the roller driving unit 112 is configured to be operable while switching a moving mode in which the pressurizing roller 46 is allowed to reciprocate and a regulation mode in which the pressurizing roller 46 is regulated from moving. The control unit 90 controls mode switching and an operation of the roller driving unit 112.

In the third exemplary embodiment, as an example of mode switching of the roller driving unit 112, the moving mode is selected when recording is performed on the medium M, and the regulation mode is selected when the adhesive force F is measured.

The control unit 90 is capable of detecting the load T acting on the pressurizing roller 46 when the roller driving unit 112 regulates the pressurizing roller 46 from reciprocating in the Y-direction. Specifically, the control unit 90 converts a magnitude of the excitation current IA, which is required to flow to the motor 73, into the load T so as to prevent the pressurizing roller 46 from moving in the +Y-direction, and thus detects the load T. The load T is converted based on correlation data with the excitation current IA that is set in advance. Further, the control unit 90 determines the magnitude of the adhesive force F of the adhesive layer AD, based on the detected load T.

In other words, as the adhesive force F of the adhesive layer AD is large, the pressurizing roller 46 is to translate in the Y-direction together with the glue belt 42. Thus, the excitation current IA to flow to the motor 73 is increased. Therefore, when a change of the excitation current IA is detected, the magnitude of the adhesive force F can also be determined.

Note that movement of the pressurizing roller 46 is not limited to translation, and may include rolling that changes the position in the +Y-direction during rotation. A rotation amount of the pressurizing roller 46 while moving in the +Y-direction changes due to a frictional force acting between each of the members forming the roller driving unit 112. Thus, when the pressurizing roller 46 performs perfect translation, accuracy of data relating to the adhesive force F is higher. However, even when the pressurizing roller 46 rotates, the adhesive force F can be detected at a certain accuracy.

Next, with reference to FIG. 11 and FIG. 12, actions of the printer 10 and the transport unit 110 according to the third exemplary embodiment are described.

According to the transport unit 110, the pressurizing roller 46 presses the medium M against the adhesive layer AD. At least a part of the pressurizing roller 46 is in contact with the adhesive layer AD. Here, when the glue belt 42 moves in the +Y-direction, the control unit 90 controls the roller driving unit 112 to regulate movement of the pressurizing roller 46. Further, in a regulation state, the pressurizing roller 46 is separated from the adhesive layer AD along with movement of the glue belt 42 in the +Y-direction.

At this state, the control unit 90 detects the load T acting on the roller driving unit 112, and thus determines whether the magnitude of the adhesive force F of the adhesive layer AD is less than the target value F2. For example, when the load T1 smaller than the predetermined load T2 acts on the roller driving unit 112, the control unit 90 determines that the magnitude of the adhesive force F of the adhesive layer AD is less than the target value F2. In this manner, the load T acting on the pressurizing roller 46 coming into contact with the adhesive layer AD is directly detected using the roller driving unit 112, and thus an influence due to slippage of the glue belt 42 or the like can be suppressed as compared to a configuration of detecting driving of the glue belt 42. Thus, the magnitude of the adhesive force F can be determined at a high accuracy.

Similarly to the transport unit 110, according to the printer 10 of the third exemplary embodiment, the magnitude of the adhesive force F of the adhesive layer AD can be determined, and thus the adhesive force F of the adhesive layer AD can be controlled. With this, when the recording head 32 ejects the ink K onto the medium M, position deviation of the medium M with respect to the glue belt 42 can be suppressed. Thus, deviation of the ejection position of the ink K with respect to the medium M can be suppressed.

Other Modified Examples

The transport units 40, 100, and 110 and the printer 10 according to the first exemplary embodiment, the second exemplary embodiment, the third exemplary embodiment, and the modified examples of the present disclosure basically have the configurations as described above. However, as a matter of course, for example, the configurations may be partially changed, omitted, or combined without departing from the gist of the disclosure of the present application. Other modified examples are described below.

In the transport unit 40, the glue belt 42 is not limited to have a cylindrical shape, and may have a flat plate shale. For example, there may be adopted a configuration in which a flat-plate transport belt extending in the Y-direction is wound using a winding unit to move the medium M in the +Y-direction.

When the magnitude of the adhesive force F is less than the target value F2, the control unit 90 may cause the notification unit 86 to issue a notification indicating reformation of the adhesive layer AD by application of an adhesive material, without increasing a pressing force. Similarly, when the magnitude of the adhesive force F is less than the target value F2, the control unit 90 may cause the notification unit 86 to issue a notification indicating reformation of the adhesive layer AD by application of an adhesive material, without increasing an output of the heating unit 84.

In the transport unit 40, the first speed V1 and the second speed V2 may be set to be equal to each other. Further, in the transport unit 40, there may be adopted a configuration in which notification by the notification unit 86 is not performed. For example, there may be adopted a configuration of forcefully stopping transport of the medium M or preventing transport of the medium M from starting when the magnitude of the adhesive force F is less than the target value F2.

In the transport unit 100, the direction in which the pressurizing roller 102 is moved is not limited to the orthogonal Z-direction, and may be a direction obliquely intersecting with the Y-direction. Further, in the transport unit 100, the heating unit 84 or the notification unit 86 may be operated.

In the transport unit 110, the roller driving unit 112 may only function as an example of a regulation unit without reciprocating the pressurizing roller 46 in the Y-direction. Further, in the transport unit 110, the heating unit 84 or the notification unit 86 may be operated.

After the base 57 stops movement by coming into contact with the regulation pin 59A, the pressurizing roller 46 stably rotates. Such rotation may be utilized in the transport unit 110. After the base 57 stops movement by coming into contact with the regulation pin 59A, the pressurizing roller 46 continues rotation more easily. A rotation torque for rotating the pressurizing roller 46 is increased as the adhesive force F is increased. The rotation torque is also transmitted to the motor 73 via a dynamic power transmission mechanism. Thus, an output current of the motor 73 is detected, and thus the adhesive force F is determined. Note that an output voltage may be detected in place of the output current.

The pressing unit is not limited to the pressurizing rollers 46 and 102 that have a columnar shape or a cylindrical shape and have a part of the outer circumferential surface coming into contact with the adhesive layer AD. The pressing unit may be configured to have a pad shape, and an entire contact surface thereof may come into contact with the adhesive layer AD.

The pressurizing rollers 46 and 102 may include a cylindrical portion formed of a resin, in place of the elastic portion 47.

The configuration is only required to enable determination of the adhesive force F of the adhesive layer AD, and a receiving member that receives a pressing force from the pressurizing rollers 46 and 102 may be present or absent on the inner side of the glue belt 42.

What is claimed is:

1. A transport device, comprising:

a transport belt including an adhesive layer and configured to transport a medium caused to adhere to the adhesive layer;

a pressing unit configured to press the medium against the adhesive layer while reciprocating in a transport direction in which the medium is transported and a reverse transport direction opposite to the transport direction, the pressing unit being configured to come into contact with the adhesive layer at at least a part of the pressing unit;

a driving unit configured to generate a driving force for the pressing unit to reciprocate in the transport direction and the reverse transport direction; and a control unit configured to control the driving unit, wherein the pressing unit is separated from the adhesive layer along with reciprocation in the transport direction and the reverse transport direction, the control unit is configured to detect a load of the driving unit, and determines a magnitude of an adhesive force of the adhesive layer, based on the load, the control unit is configured to execute:

a determination mode in which the adhesive force is determined based on the load, and a transport mode in which the medium is transported after the determination mode, and the control unit controls the driving unit so that a first speed is higher than a second speed, the first speed being a speed of the pressing unit at which the pressing unit moves in the determination mode and the second speed being a speed of the pressing unit at which the pressing unit moves in the transport mode.

2. The transport device according to claim 1, wherein the transport belt is a cylindrical belt member and the control unit detects the load of the driving unit while circularly moving the transport belt.

3. The transport device according to claim 1, wherein the pressing unit is provided such that a pressing force when pressing the medium against the transport belt is changeable and when it is determined that a magnitude of the adhesive force is less than a target value, the control unit controls the pressing unit to increase the pressing force.

4. The transport device according to claim 1, wherein the pressing unit includes a heating unit configured to heat the medium and when it is determined that a magnitude of the adhesive force is less than a target value, the control unit increases an output of the heating unit to increase a temperature of the medium.

5. The transport device according to claim 1, further comprising:

a notification unit configured to issue a notification relating to information, wherein when it is determined that a magnitude of the adhesive force is less than a target value, the control unit causes the notification unit to issue a notification relating to information indicating reduction in the magnitude of the adhesive force.

6. A transport device, comprising:

a transport belt including an adhesive layer and configured to transport a medium caused to adhere to the adhesive layer;

a pressing unit that is provided movably in an intersecting direction intersecting with a transport direction in which the medium is transported and that is configured to press the medium against the adhesive layer, the pressing unit being configured to come into contact with the adhesive layer at at least a part of the pressing unit;

a driving unit configured to generate a driving force for the pressing unit to move in the intersecting direction; and a control unit configured to control the driving unit, wherein the pressing unit is separated from the adhesive layer along with movement in the intersecting direction, the control unit is configured to detect a load of the driving unit, and determines a magnitude of an adhesive force of the adhesive layer, based on the load, the control unit is configured to execute:

a determination mode in which the adhesive force is determined based on the load, and a transport mode in which the medium is transported after the determination mode, and the control unit controls the driving unit so that a first speed is lower than a second speed, the first speed being a speed of the pressing unit at which the pressing unit moves in the determination mode and the second speed being a speed of the pressing unit at which the pressing unit moves in the transport mode.

7. A transport device, comprising:

a transport belt including an adhesive layer and configured to transport a medium caused to adhere to the adhesive layer;

a pressing unit that is provided reciprocably in a transport direction in which the medium is transported and a reverse transport direction opposite to the transport direction and that is configured to press the medium against the adhesive layer, the pressing unit being configured to come into contact with the adhesive layer at at least a part of the pressing unit;

a regulation unit configured to regulate reciprocation of the pressing unit; and a control unit configured to control the regulation unit, wherein the pressing unit is configured to be separated from the adhesive layer along with movement of the transport belt and the control unit is configured to detect a load acting on the regulation unit when the regulation unit regulates the pressing unit, and determines a magnitude of an adhesive force of the adhesive layer, based on the load.

8. A liquid ejection device, comprising:

an ejection unit configured to eject a liquid onto a medium;

a transport belt including an adhesive layer and configured to transport the medium caused to adhere to the adhesive layer;

a pressing unit configured to press the medium against the adhesive layer while reciprocating in a transport direction in which the medium is transported and a reverse transport direction opposite to the transport direction, the pressing unit being configured to come into contact with the adhesive layer at at least a part of the pressing unit;

a driving unit configured to generate a driving force for the pressing unit to reciprocate in the transport direction and the reverse transport direction; and a control unit configured to control the driving unit, wherein the pressing unit is separated from the adhesive layer along with reciprocation in the transport direction and the reverse transport direction and the control unit is configured to detect a load of the driving unit, and determines a magnitude of an adhesive force of the adhesive layer, based on the load, the control unit is configured to execute:

a determination mode in which the adhesive force is determined based on the load and, a transport mode in which the medium is transported after the determination mode, and the control unit controls the driving unit so that a first speed is higher than a second speed, the first speed being a speed of the pressing unit at which the pressing unit moves in the determination mode and the second speed being a speed of the pressing unit at which the pressing unit moves in the transport mode.

9. A liquid ejection device, comprising:

an ejection unit configured to eject a liquid onto a medium;

a transport belt including an adhesive layer and configured to transport the medium caused to adhere to the adhesive layer;

a pressing unit that is provided movably in an intersecting direction intersecting with a transport direction in which the medium is transported and that is configured to press the medium against the adhesive layer, the pressing unit being configured to come into contact with the adhesive layer at at least a part of the pressing unit;

a driving unit configured to generate a driving force for the pressing unit to move in the intersecting direction; and a control unit configured to control the driving unit, wherein the pressing unit is separated from the adhesive layer along with movement in the intersecting direction and the control unit is configured to detect a load of the driving unit, and determines a magnitude of an adhesive force of the adhesive layer, based on the load, the control unit is configured to execute:

a determination mode in which the adhesive force is determined based on the load, and a transport mode in which the medium is transported after the determination mode, and the control unit controls the driving unit so that a first speed is lower than a second speed, the first speed being a speed of the pressing unit at which the pressing unit moves in the determination mode and the second speed being a speed of the pressing unit at which the pressing unit moves in the transport mode.

10. A liquid ejection device, comprising:

an ejection unit configured to eject a liquid onto a medium;

a transport belt including an adhesive layer and configured to transport the medium caused to adhere to the adhesive layer;

a pressing unit that is provided reciprocably in a transport direction in which the medium is transported and a reverse transport direction opposite to the transport direction and that is configured to press the medium against the adhesive layer, the pressing unit being configured to come into contact with the adhesive layer at at least a part of the pressing unit;

a regulation unit configured to regulate reciprocation of the pressing unit; and a control unit configured to control the regulation unit, wherein the pressing unit is configured to be separated from the adhesive layer along with movement of the transport belt and the control unit is configured to detect a load acting on the regulation unit when the regulation unit regulates the reciprocation of the pressing unit, and determines a magnitude of an adhesive force of the adhesive layer, based on the load.

* * * * *